United States Patent [19]

Raidt et al.

[11] Patent Number: 4,574,541

[45] Date of Patent: Mar. 11, 1986

[54] FOUNDATION-DRAINAGE PANEL

[75] Inventors: Heinz P. Raidt, Dortmund; Dieter Jablonka; Klaus Urban, both of Herdecke, all of Fed. Rep. of Germany

[73] Assignee: Ewald Dörken GmbH & Co. KG, Herdecke, Fed. Rep. of Germany

[21] Appl. No.: 616,005

[22] Filed: May 31, 1984

Related U.S. Application Data

[63] Continuation-in-part of Ser. No. 397,105, Jul. 12, 1982, abandoned.

[30] Foreign Application Priority Data

Jul. 10, 1981 [DE] Fed. Rep. of Germany ..... 3127265

[51] Int. Cl.[4] ..... E02D 19/00; E02D 31/02; E02B 11/00

[52] U.S. Cl. ..... 52/169.5; 52/801; 52/811; 210/346; 405/45

[58] Field of Search ..... 52/169.14, 169.5, 169.8, 52/811, 801, 451, 292, 293; 405/45, 49; 428/280; 210/346

[56] References Cited

U.S. PATENT DOCUMENTS

| | | | |
|---|---|---|---|
| 2,771,164 | 11/1956 | Scurlock | 52/574 X |
| 3,396,071 | 8/1968 | Couzens | 428/280 |
| 3,563,038 | 2/1971 | Healy et al. | 405/45 |
| 3,654,765 | 4/1972 | Healy et al. | 405/45 |
| 3,669,821 | 8/1968 | Sharp | 52/801 |
| 3,754,362 | 8/1973 | Daimler et al. | 52/169.5 |
| 3,888,087 | 6/1975 | Bergsland | 52/169.14 |
| 4,045,964 | 9/1977 | Barclay | 52/169.5 |
| 4,057,500 | 11/1977 | Wager | 405/43 |
| 4,070,839 | 1/1978 | Clem | 52/451 |
| 4,309,855 | 1/1982 | Pate et al. | 52/169.5 |

FOREIGN PATENT DOCUMENTS

| | | | |
|---|---|---|---|
| 1123817 | 2/1962 | Fed. Rep. of Germany . | |
| 2203206 | 8/1972 | Fed. Rep. of Germany . | |
| 2343866 | 4/1975 | Fed. Rep. of Germany . | |
| 2521374 | 12/1976 | Fed. Rep. of Germany . | |
| 2947499 | 2/1982 | Fed. Rep. of Germany . | |
| 7905922 | 2/1981 | Netherlands | 405/49 |
| 107188 | 9/1965 | Norway | 52/169.5 |
| 1334963 | 10/1973 | United Kingdom . | |

*Primary Examiner*—Alfred C. Perham
*Assistant Examiner*—Jean M. LaKemper
*Attorney, Agent, or Firm*—Karl F. Ross; Herbert Dubno

[57] ABSTRACT

A construction element for foundation drainage has an integral, flexible, and substantially water-impervious panel lying generally in a plane and formed with respective arrays of inner and outer bumps to opposite sides of the plane. The outer bumps form outwardly open outer flow channels on the outer face. Normally the panel is applied to a vertical foundation wall with the inner bumps bearing against the wall and the outer passages vertical and opening outward away from the wall. The inner bumps and outer bumps are offset to one another in the plane in two perpendicular directions. Thus the channels communicate also in these two directions and the element can be rolled up. A water-pervious and rigid filter sheet overlies the outer bumps, is spaced outward from the plane, and outwardly closes the channels so that water can filter through the sheet and flow down the channels.

9 Claims, 9 Drawing Figures

FOUNDATION-DRAINAGE PANEL

CROSS REFERENCE TO RELATED APPLICATION

This application is a continuation-in-part of our copending patent application Ser. No. 397,105 filed 12 July 1982 now abandoned.

FIELD OF THE INVENTION

The present invention relates to a foundation-drainage panel. More particularly this invention concerns such a panel which is buried against the outside of a foundation of a building to conduct water therefrom.

BACKGROUND OF THE INVENTION

Water can pass relatively easy through the standard concrete block used for foundations. In an area with a high water table it is necessary to provide drainage around the underground foundation of a building if there is a subsurface room or cellar. It is usually not enough simply to waterproof the outside of the foundation walls. A tile drainage pipe is run along the foot of each buried foundation wall, and the foundation is externally waterproofed and backfilled with gravel. Thus water in the ground does not lie against the outer surface of the wall, but passes down through the gravel to the porous tile pipe.

This procedure has several drawbacks. During backfilling of the foundation, the waterproof layer—normally a thick coating of tar—is almost invariably damaged and pierced, so that leaks are formed. The gravel and drainage on the outside prevent such minor leaks from being troublesome except under very wet conditions, but the foundation walls still do leak at least some times. In addition the bituminous coating sometimes breaks down somewhat chemically, cracking and leaking. Finally in such arrangements the outer surface of the foundation walls, which are mainly of heat-conducting concrete, always is resting against the ground outside so that the foundation is quite cold and usually also somewhat damp if for no other reason than from condensation on the wall from inside the basement or cellar.

German patent Ser. No. 2,947,499 describes a polyethylene sheet lying generally in a plane and formed with bumps opening in one direction perpendicularly from the plane. Such an impact-resistant sheet is placed against the outside face of the foundation walls and holds the backfill out of contact with these walls. At the same time it forces water coming laterally at it to percolate down to the foot of the wall where, as described above, a porous tile pipe, normally bedded in gravel, is buried. Such an arrangement quickly silts up, that is becomes clogged with fine dirt, so that water can no longer move along it. Thus it stands against the held-back water for great periods of time, until it has all slowly percolated down, giving this water plenty of opportunity to leak through it. Furthermore, it transmits heat from the building out into the dirt, thereby leaving the foundation wall cold on the inside.

It is also known to place large bitumen-covered polystyrene-foam sheets against the outer wall surface. These are tarred in place or at least the joints are tarred to provide a waterproof insulating layer. Such panels are normally about 5 cm thick, 100 cm long, and 50 cm wide, so they are quite bulky, and therefore costly. They have not proven themselves to be physically or chemically stable in the long run, and are liable to silting up so they do not drain. This filling with fine dirt can be countered by applying a filter sheet, normally a porous but rigid textile web, to the outer face of the polystyrene sheets. Any gap in this arrangement makes, however a leak, and the panels are not particularly strong so they are easily damaged in transport or installation. Thus leaks are common.

Norwegian Pat. No. 107,188 of Bordewick shows an arrangement wherein an impervious sheet is formed with an array of inner bumps that hold it away from a wall. The other side of this foil, that is its side turned toward and contacting the ground, is smooth and is only interrupted by the irregularities formed by the bumps. The outer surface is otherwise smooth and uninterrupted, so that there is little drainage along this outer side.

U.S. Pat. No. 3,654,765 of Healy describes a foundation-drainage panel having an inflexible core element that is sandwiched between a water-pervious mesh and an impervious sheet. The entire arrangement is in fact quite rigid and is normally integrated with a rigid drain pipe. In addition the channels in this system are purely vertical, so that if stopped up they will fill and overflow above the element, forcing water behind the sheet against the wall. This type of arrangement can only be used against a flat building surface and cannot even be cut up conveniently to fit other than standard sizes. It can be bent about an axis parallel to its ridges, but not perpendicular thereto. Such deformation perpendicular to the ridges creases them and limits or eliminates flow along them. In addition in this arrangement the filter mesh overlies the ridges so that about half of its surface area is useless, as it lies directly against the crests of the ridges or bumps.

OBJECTS OF THE INVENTION

It is therefore an object of the present invention to provide an improved foundation-drainage panel.

Another object is the provision of such a foundation-drainage panel which overcomes the above-given disadvantages, that is which prevents water from getting to and through the wall, conducts this water down to the drainage tile at its foot, and even provides some insulation for the foundation wall.

A further object is to further principles of the parent patent application, in particular by being adaptable to any size or shape of all while being particularly easy and cheap to manufacture.

SUMMARY OF THE INVENTION

A construction element for foundation drainage according to the invention has an integral, flexible, and substantially water-impervious panel lying generally in a plane and formed with respective arrays of inner and outer bumps to opposite sides of the plane. The outer bumps form outwardly open outer flow channels on the outer face. Normally the panel is applied to a vertical foundation wall with the inner bumps bearing against the wall and the outer passages vertical and opening outward away from the wall. The inner bumps and outer bumps are offset to one other in the plane in two perpendicular directions. Thus the channels communicate also in these two directions and the element can be rolled up. A water-pervious and rigid filter sheet overlies the outer bumps, is spaced outward from the plane, and outwardly closes the channels so that water can filter through the sheet and flow down the channels.

Thus with the system of this invention flow can take place on both sides of the panel. On the outside the ground water can filter through the filter sheet and then pass down the passages and on the inside it can pass down the panel between the inner bumps, normally staying clear of the outer surface of the wall to which the panel is applied. The wall is therefore juxtaposed with an air space defined in part by the inner face of the panel.

The bumps according to this invention are uniformly distributed over the panel and the inner bumps define and extend to an inner plane and the channels have bases lying in plane offset therefrom. Thus only a small portion of the area of the panel actually will engage the wall it is protecting, keeping it as dry as possible.

In accordance with another feature of this invention the inner and outer bumps are arrayed in rows and the rows of the inner bumps extend generally perpendicular to the rows of the outer bumps. More particularly, the panel is formed with an array of inner grooves extending parallel to the plane and with an array of outer grooves also extending parallel to the plane but generally perpendicular to the inner grooves. The inner grooves and outer grooves together define the bumps.

The panel according to this invention is normally rectangular and elongated. One of the arrays of grooves extends lengthwise of the panel and the other array extends perpendicular thereto. It is also possible for the grooves to extend diagonally, that is at an angle between 45° and 135° to the panel.

In accordance with other features of this invention the inner bumps are generally circular at the inner plane. In addition these inner bumps project inward from the bases of the outer grooves and the outer bumps project outward from the bases of the inner grooves.

The panel of this invention of generally uniform thickness at and between the bumps. This thickness is between 0.3 mm and 1.0 mm, and the web has a weight of between 0.08 kg/m$^2$ and 0.15 kg/m$^2$. Normally according to the invention the web is a polypropylene felt and the panel is of polyethylene.

DESCRIPTION OF THE DRAWING

The above and other features and advantages will become more readily apparent from the following, it being understood that any feature described with reference to only one embodiment of the invention can be used where possible with any other embodiment. In the accompanying drawing.

SPECIFIC DESCRIPTION

Figure 3:
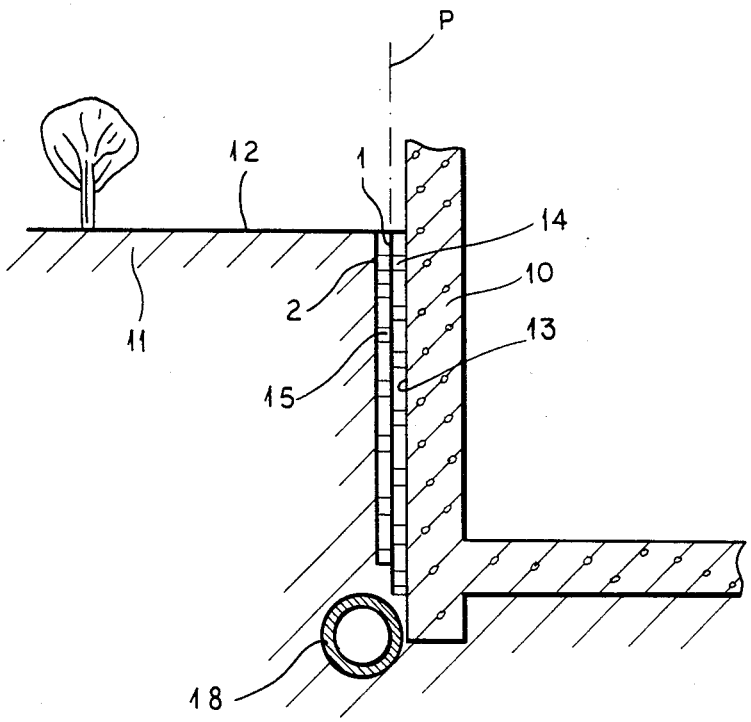
* and FIG. 3 is a small-scale sectional view illustrating the use of the element according to this invention.

As seen in FIG. 3, a basement wall 10 is sunk in the ground 11 below the ground level 12. At its foot is a porous tile drainage pipe 18 that is backfilled with gravel. The outer surface of the wall 10 is provided with a tar coating 13 that substantially waterproofs it.

Figure 1:
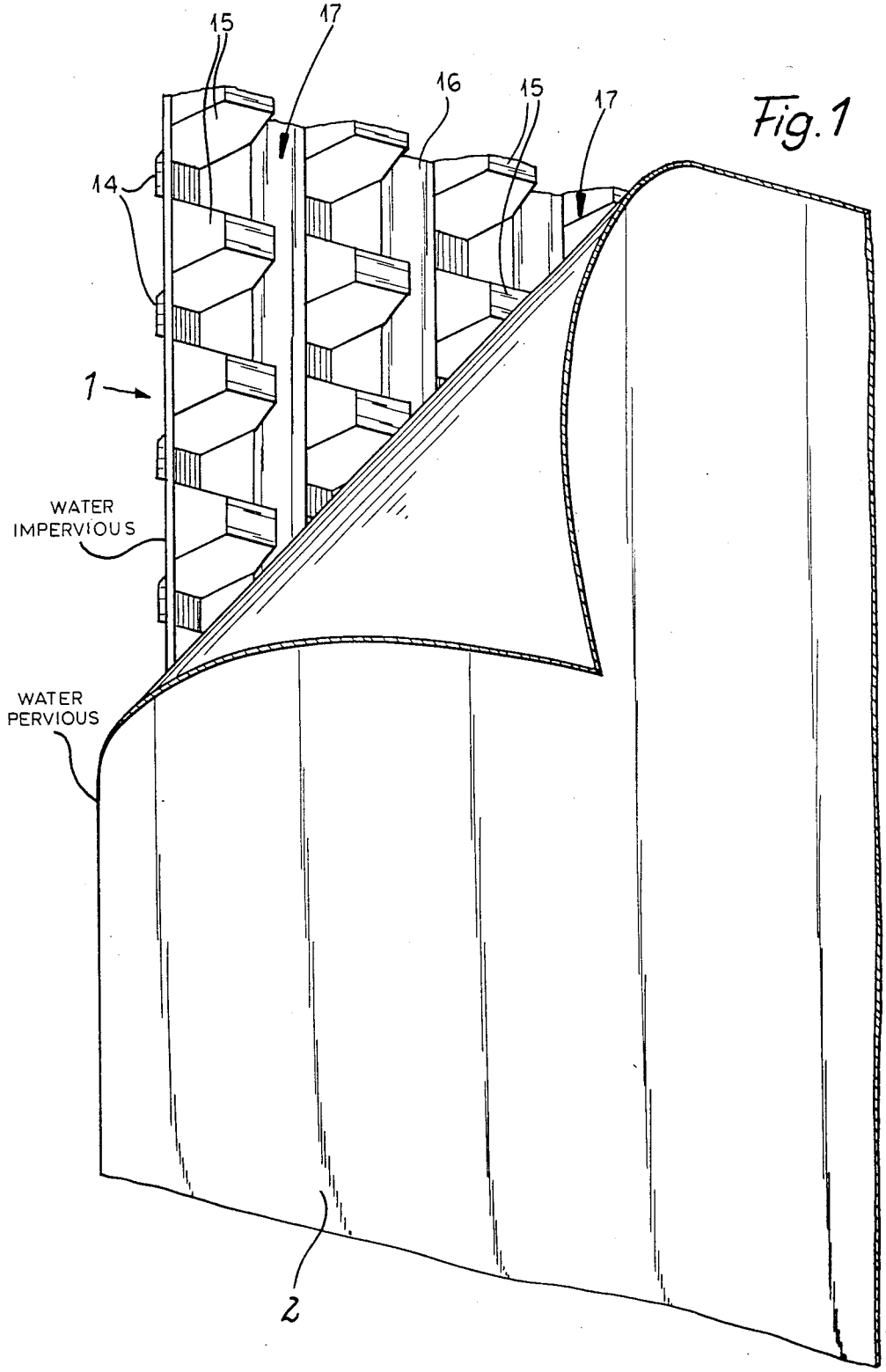
FIG. 1 is a perspective view of portions of a drainage panel according to this invention.

According to the instant invention a panel 1 is formed as also seen in FIG. 1 with an array of inner trapezoidal-section bumps 14 and complementary outer bumps 15, and between these bumps 14 and 15 with longitudinal ridges 16. A stiff filter screen 2 is adhered to the bumps 15 and ridges 16. The panel 1 defines a plane P, with the bumps or projections 14 directed inward therefrom and engaging the waterproofed outer surface 13 of the wall 10, and the other bumps or projections 15 and 16 hold the sheet 2 parallel to but outwardly offset from the plane P. This forms vertical passages 17 between the panel 1 and sheet 2.

Thus any ground water will pass through the filter screen 2 and be able to flow down the passages 17 to the pipe 18. Any moisture that somehow gets through this panel 1 will flow down its inside face to the tile 18, so that there is little likelihood of leakage through the wall 10 even if it has no coating 13.

In addition the projections 14 hold the panel 1 off the wall 10 so that an air-filled space is formed between the panel 1 and the wall 10. This space insulates the panel 1 from the flat tops that lie flatly against the wall 10 so that they will not puncture it.

The panel 1 is made of polyethylene, known for its chemical stability, low cost, and impact resistance. When it is between 0.3 mm and 1.0 mm thick the panel 1 will have a weight of between 0.3 kg/m$^2$ and 1.0 kg/m$^2$. The sheet 2 is a polypropylene felt having a substantially lighter weight of between 0.08 kg/m$^2$ and 0.15 kg/m$^2$. Thus the construction element of this invention is quite light.

Figure 2A:
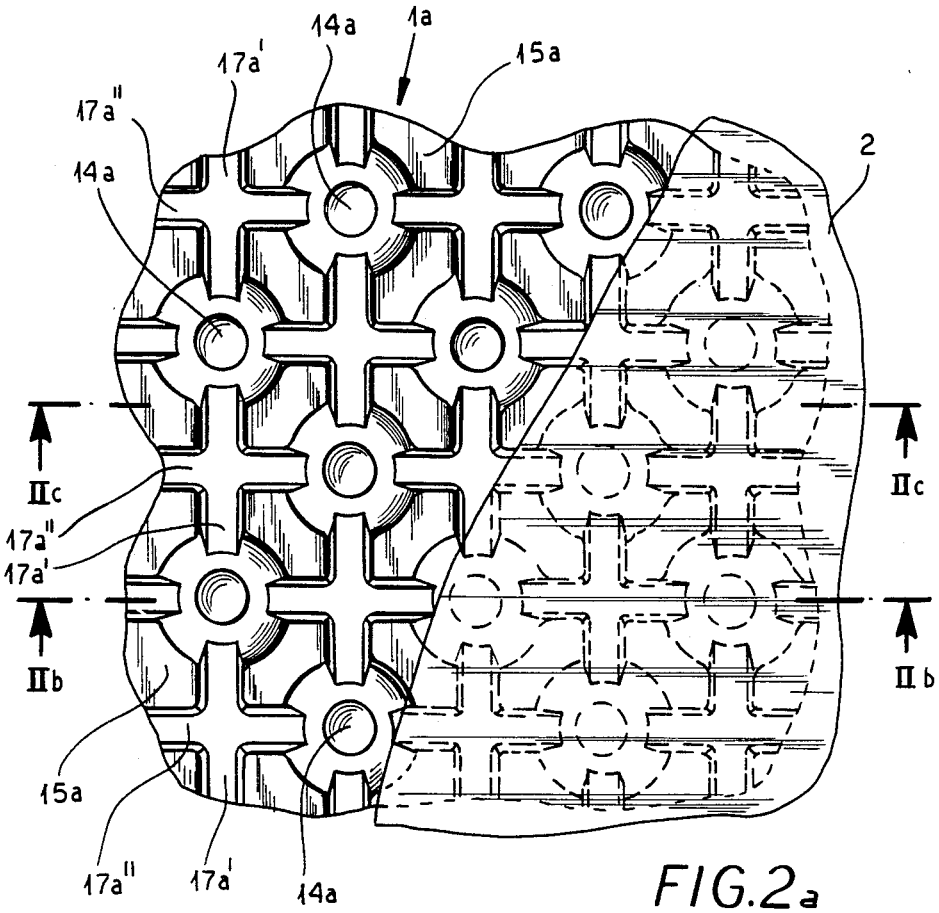
FIG. 2*a* is a partly broken away perspective view of another drainage panel according to the instant invention.
Figure 2B:
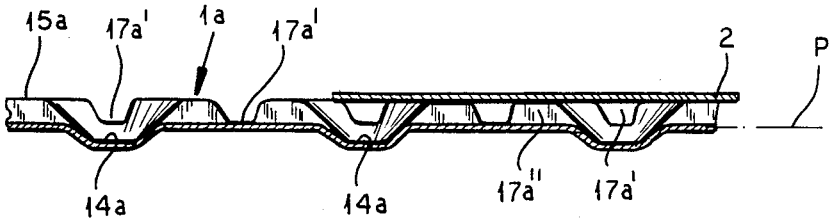
FIGS. 2*b* and 2*c* are sections taken respectively along lines IIb—IIb and IIc—IIc of FIG. 2*a;*
Figure 2C:
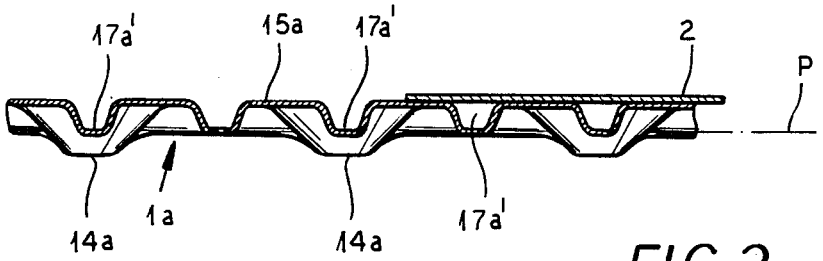
Figure 2D:
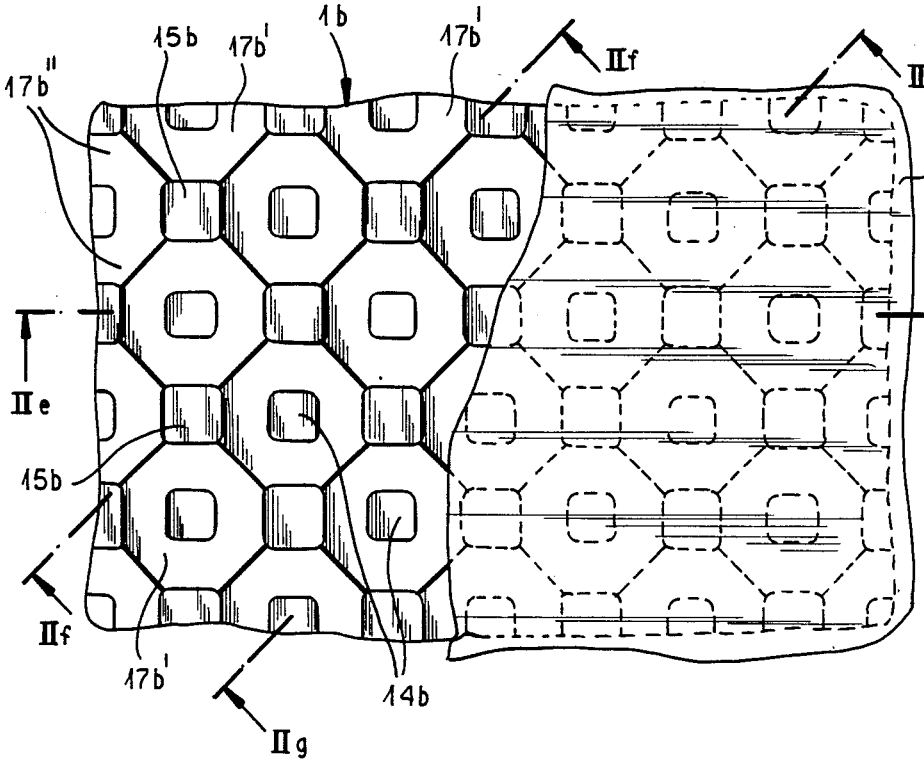
FIG. 2*d* is a view like FIG. 2*a* of a further drainage panel in accordance with this invention.
Figure 2E:
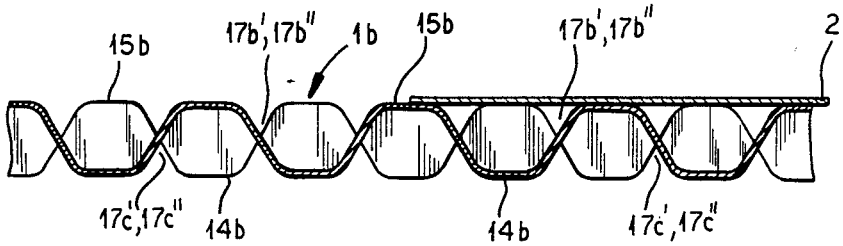
FIGS. 2*e*, 2*f*, and 2*g* are sections respectively taken along lines IIe—IIe, IIf—IIf, and IIg—IIg of FIG. 2*d.
Figure 2F:
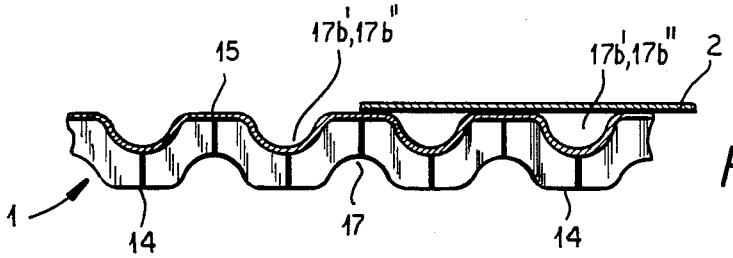
Figure 2G:
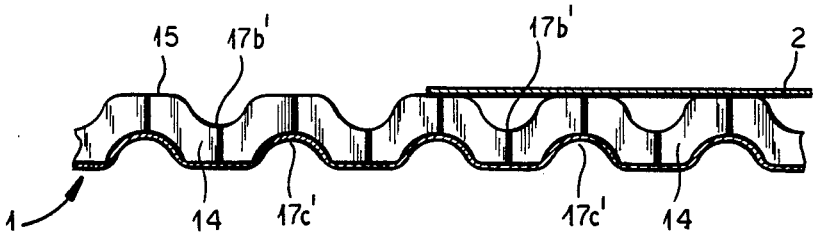

As seen in FIGS. 2*a*, 2*b*, and 2*c* a panel 1*a* can be formed with longitudinal and transverse grooves 17*a'* and 17*a''* that are all open toward the filter screen 2 and can be formed at every other intersection of each longitudinal groove 17*a'* and transverse groove 17*a''* with a frustoconical bump 14*a* projecting from the back plane P. Thus flow through the mesh 2 down in the grooves 17*a'* and 17*a''* is extremely free, while flow between the plane P and the surface 13 is relatively unimpeded between the bumps 14*a* also. In fact if some silt or the like clogs a spot between the panel 1*a* and the surface 13, downward flow can pass easily to the sides and then down again, as the bumps 14*a* do not appreciably impede flow in any direction.

These bumps 14*a* not only serve to hold the panel 1*a* off the wall surface 13, but their base diameters are such that they take up much of the surface area of the panel 1 not already occupied by the grooves 17*a'* and 17*a''*. This leaves lands 15*a* which are in effect only projections from the bases of the grooves 17*a'* and 17*a''* and that constitute only a small portion, less than one quarter, of the surface area of the panel 1. Since the mesh 2 only lies against the panel 1*a* at these lands 15*a*, the restriction to flow through the mesh 2 is minimized at this side of the panel 1*a*.

Obviously the crossing grooves 17*a'* and 17*a''* permit the panel 1*a* to flex in any direction and to permit flow on both sides in any direction parallel to the plane P. Since, like most construction panels, the panels according to this invention are supplied in rectangles having a height equal to twice their width, it is possible to use the panels either vertically or horizontally, thereby facilitating application.

In the arrangement of FIGS. 2*d*, 2*e*, 2*f*, and 2*g* a panel 1*b* has semicylindrical diagonal and crossing grooves 17*b*′ and 17*b*″ opening on its one face and on its opposite face and interleaved therewith, mutually perpendicular diagonal grooves 17*c*′ and 17*c*″ that open oppositely outwardly, normally toward the wall surface 13 when installed. The lands formed between the back grooves 17*c*′ and 17*c*″ constitute the projections 14*b* and those between the front grooves constitute the front projections 15*b*. The lands 14*b* are in effect backward projections from the front grooves 17*b*′ and 17*b*″ and the lands 15*b* are forward projections from the bases of the back grooves 17*c*′ and 17*c*″. Once again the surface area in contact with the surface 13 and the web 2 is minimized, and flow can take place parallel to the plane P in virtually any direction on both sides of the panel 1*b*.

We claim:

1. In combination with a vertical foundation wall, a construction element for draining said vertical foundation wall, the element comprising:

an integral and substantially water-impervious panel of generally uniform thickness and lying generally in a central plane and formed with respective arrays of inner and outer bumps generally uniformly distributed over the panel to opposite sides of the central plane and having respective bases defining inner and outer planes flanking and offset respectively horizontally inwardly and horizontally outwardly from the central plane, the outer bumps forming outwardly open outer flow channels on the outer face, the panel being applied to the vertical foundation wall with only the bases of the inner bumps bearing against the wall at the inner plane at vertically and horizontally offset locations thereon and the outer channels vertical and opening outward away from the wall, the inner bumps and outer bumps being offset to one other parallel to the planes in two perpendicular directions, the channels communicating also in these two directions, the element being sufficiently flexible that it can be rolled up; and a water-pervious and rigid filter sheet overlying the panel at the outer plane, engaging the panel only at horizontally and vertically spaced locations at the bases of the outer bumps and outwardly closing the channels, whereby water can filter through the sheet and flow down the channels.

2. The foundation-drainage construction element defined in claim 1 wherein the inner and outer bumps are arrayed in straight rows and the rows of the inner bumps extend generally perpendicular to the rows of the outer bumps.

3. The foundation-drainage construction element defined in claim 1 wherein the thickness is between 0.3 mm and 1.0 mm, and the sheet has a weight of between 0.08 kg/m$^2$ and 0.15 kg/m$^2$.

4. The foundation-drainage construction element defined in claim 3 wherein the sheet is a polypropylene felt.

5. The foundation-drainage construction element defined in claim 1 wherein the panel is of polyethylene.

6. In combination with a vertical foundation wall, a construction element for draining said vertical foundation wall, the element comprising:

an integral and substantially water-impervious panel of generally uniform thickness and lying generally in a central plane and formed with respective arrays of inner and outer bumps generally uniformly distributed over the panel to opposite sides of the central plane and having respective bases defining inner and outer planes flanking and offset respectively horizontally inwardly and horizontally outwardly from the central plane, the outer bumps forming outwardly open outer flow grooves on the outer face, the panel being applied to the vertical foundation wall with only the bases of the inner bumps bearing against the wall at the inner plane at vertically and horizontally offset locations thereon and the outer grooves opening outward away from the wall, the inner bumps and outer bumps being offset from one another parallel to the planes in two perpendicular directions, the grooves communicating also in these two directions, the element being sufficiently flexible that it can be rolled up; and a water-pervious and rigid filter sheet overlying the panel at the outer plane, engaging the panel only at horizontally and vertically spaced locations at the bases of the outer bumps and outwardly closing the grooves, whereby water can filter through the sheet and flow down the grooves, the panel being formed with an array of inner grooves extending parallel to the planes, said outer grooves forming an array also extending parallel to the planes but generally perpendicular to the inner grooves, the inner grooves and outer grooves extending between the bumps.

7. The foundation-drainage construction element defined in claim 6 wherein the element is elongated and one of the arrays of grooves extends lengthwise of the panel and the other array extends perpendicular thereto.

8. The foundation-drainage construction element defined in claim 6 wherein both arrays extend at an angle of between 45° and 135° to the longitudinal direction of the panel.

9. The foundation-drainage construction element defined in claim 6 wherein the inner bumps are generally circular at the inner plane.

* * * * *